US011300128B2

(12) United States Patent
Register et al.

(10) Patent No.: US 11,300,128 B2
(45) Date of Patent: Apr. 12, 2022

(54) BLADELESS CEILING FAN

(71) Applicant: Hubbell Incorporated, Shelton, CT (US)

(72) Inventors: Walter Steven Register, Anderson, SC (US); Blake Ashton Nickles, Greenville, SC (US)

(73) Assignee: Hubbell Incorporated, Shelton, CT (US)

( * ) Notice: Subject to any disclaimer, the term of this patent is extended or adjusted under 35 U.S.C. 154(b) by 134 days.

(21) Appl. No.: 16/406,130

(22) Filed: May 8, 2019

(65) Prior Publication Data

US 2019/0345946 A1 Nov. 14, 2019

Related U.S. Application Data

(60) Provisional application No. 62/670,097, filed on May 11, 2018.

(51) Int. Cl.

| | |
|---|---|
| ***F04D 25/08*** | (2006.01) |
| ***F04D 17/04*** | (2006.01) |
| ***F04D 29/00*** | (2006.01) |
| ***F04D 29/42*** | (2006.01) |

(52) U.S. Cl.

CPC ..... *F04D 17/04* (2013.01); *F04D 25/088* (2013.01); *F04D 29/002* (2013.01); *F04D 29/4226* (2013.01)

(58) Field of Classification Search

CPC .... F04D 17/04; F04D 29/002; F04D 29/4226; F04D 25/088

See application file for complete search history.

(56) References Cited

U.S. PATENT DOCUMENTS

| | | | | |
|---|---|---|---|---|
| 2,488,467 | A * | 11/1949 | De Lisio | F04F 5/16 239/561 |
| 9,004,858 | B2 | 4/2015 | Nicolas et al. | |
| 9,194,596 | B2 | 11/2015 | Dyson et al. | |
| 9,513,028 | B2 * | 12/2016 | Gammack | F04F 5/16 |
| 9,797,411 | B2 | 10/2017 | Dyson et al. | |
| 9,797,413 | B2 | 10/2017 | Stewart et al. | |
| 2016/0198296 | A1 * | 7/2016 | Jung | H04W 4/021 455/456.3 |
| 2016/0234595 | A1 * | 8/2016 | Goran | H04L 12/2827 |
| 2018/0343403 | A1 * | 11/2018 | Mehdi | H04N 5/2256 |
| 2019/0120248 | A1 * | 4/2019 | Whitmire | F04D 25/088 |
| 2019/0242391 | A1 * | 8/2019 | Whitmire | F04D 29/601 |
| 2019/0264700 | A1 * | 8/2019 | Huggins | F04D 27/002 |

* cited by examiner

*Primary Examiner* — Eldon T Brockman

(74) *Attorney, Agent, or Firm* — Michael Best & Friedrich LLP

(57) ABSTRACT

A bladeless ceiling fan is provided. The bladeless ceiling fan includes a housing configured to accommodate an electric motor. The housing can define one or more vents through which air enters an interior of the housing. The bladeless ceiling fan can further include an airfoil defining an interior passage. In addition, the bladeless ceiling fan includes one or more conduits. The one or more conduits extend from the housing to the airfoil such that air within the interior of the housing flows through the one or more conduits and into the interior passage defined by the airfoil.

20 Claims, 14 Drawing Sheets

BLADELESS CEILING FAN

PRIORITY CLAIM

The present application is based on and claims priority to U.S. Provisional App. No. 62/670,097, titled "Bladeless Ceiling Fan," having a filing date of May 11, 2018 which is incorporated by reference herein.

FIELD

The present disclosure relates generally to bladeless ceiling fans.

BACKGROUND

Ceiling fans include an electric motor and a plurality of fan blades rotatably coupled to the motor. In this manner, the motor can drive rotation of the fan blades to circulate air within a room or area in which the ceiling fan is mounted. However, noise associated with rotation of the fan blades is generally undesirable. Additionally, the air circulated by rotation of the fan blades is non-uniform (e.g., turbulent), which is also undesirable.

BRIEF DESCRIPTION

Aspects and advantages of embodiments of the present disclosure will be set forth in part in the following description, or may be learned from the description, or may be learned through practice of the embodiments.

One example aspect of the present disclosure is directed to a bladeless ceiling fan. The bladeless ceiling fan can define a vertical direction, a radial direction, and a circumferential direction. The bladeless ceiling fan can include a housing configured to accommodate an electric motor. The housing can define one or more vents through which air enters an interior of the housing. The bladeless ceiling fan can further include an airfoil defining an interior passage. In addition, the bladeless ceiling fan can include one or more conduits. The one or more conduits extend from the housing to the airfoil such that air within the interior of the housing flows through the one or more conduits and into the interior passage defined by the airfoil.

Another example aspect of the present disclosure is directed to a system for a bladeless ceiling fan mounted in a room or area. The system can include an image capture device coupleable to the bladeless ceiling fan. The image capture device can be operable to capture an image depicting at least a portion of the room or area when the image capture device is coupled to the bladeless ceiling fan.

These and other features, aspects and advantages of the present disclosure will become better understood with reference to the following description and appended claims. The accompanying drawings, which are incorporated in and constitute a part of this specification, illustrate embodiments of the invention and, together with the description, serve to explain the principles of the disclosure.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
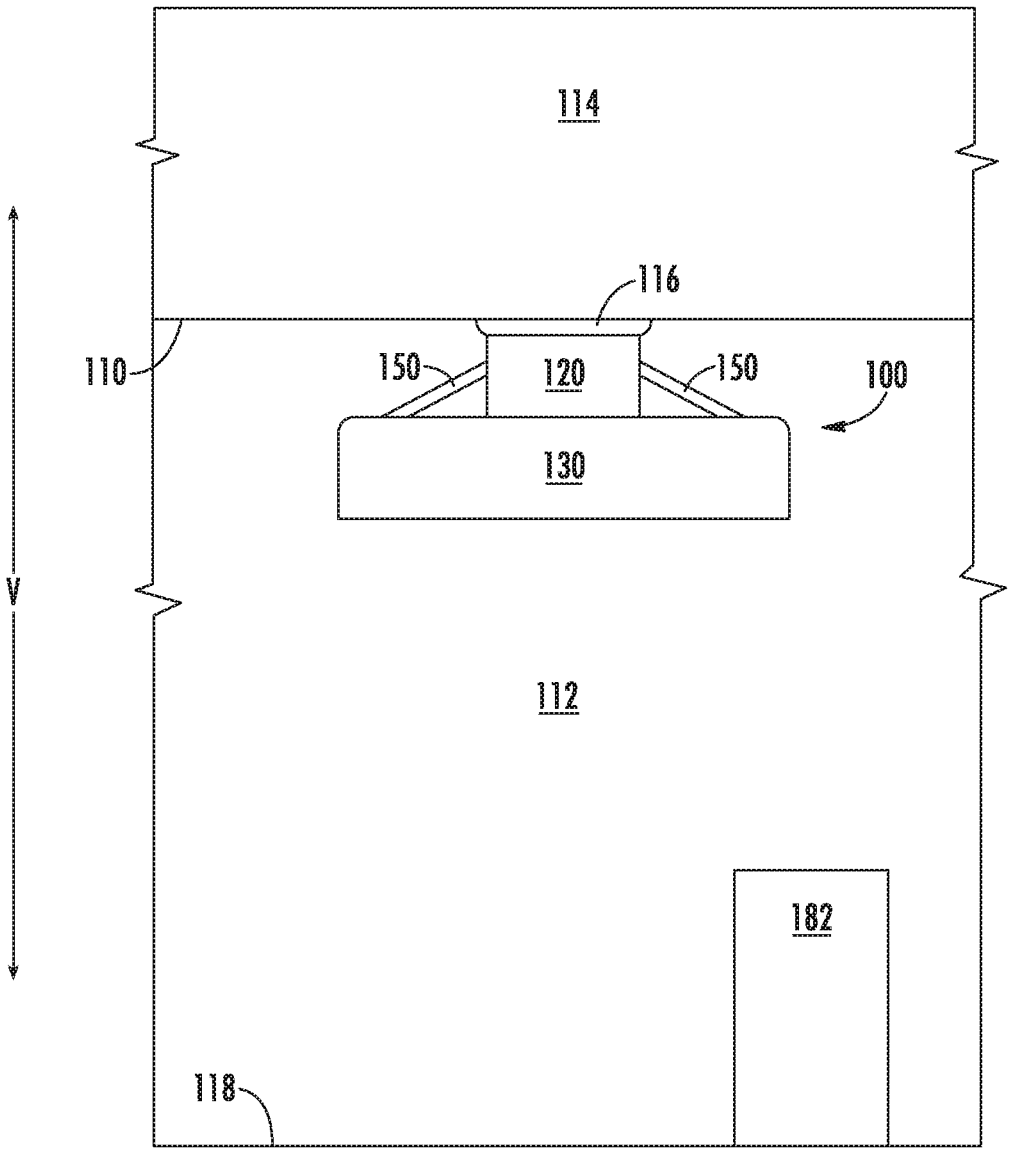
FIG. 1 provides a schematic of a bladeless ceiling fan according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to a bladeless ceiling fan. The bladeless ceiling fan can include a housing configured to accommodate a motor of the bladeless ceiling fan. The housing can define one or more vents through which air enters the interior of the housing. The bladeless ceiling fan can include an airfoil defining an interior passage. In some implementations, the housing and the airfoil can be integrally formed as a monolithic component. In this manner, the housing can be in direct fluid (e.g., air) communication with the interior passage defined by the airfoil. In alternative implementations, airfoil can be suspended from one or more conduits extending from the housing to the airfoil. In this manner, the housing can be in fluid communication with the interior passage via the conduit(s).

In some implementations, the fan can include a compressor and a motor disposed in the housing. The compressor can include an impeller and a diffuser. The impeller can be rotatably coupled to the motor via a shaft. As the motor drives rotation of one or more blades of the impeller, primary air is drawn into the interior of the housing through one or more vents of the housing. Once the primary air is inside the housing, the primary air is directed into the one or more conduits. The primary air then flows through the conduits and into an interior passage defined by the airfoil. Once inside the interior passage, the primary air flows towards an outlet defined near a leading edge of the airfoil. The primary air exits the interior passage and flows through an opening defined by the airfoil. More specifically, the primary air flows through the opening and toward/away from the housing.

When the primary air flows through the opening defied by the airfoil, the primary air flows over an exterior surface of a pressure side of the airfoil. As the primary air flows across the exterior surface of the pressure side of the airfoil, a Coanda effect occurs in which secondary air is drawn through the opening defined by the airfoil. More specifically, at least a portion of the secondary air flows over the exterior surface of the pressure side of the airfoil. In this manner, the primary air and the portion of the secondary air combine to produce a total air flow directed either towards or away from the housing.

In some embodiments, the ceiling fan can include one or more sensors operable to detect a parameter associated with at least one of the ceiling fan or the room. For instance, the sensor(s) can be configured to collect data indicative of an environmental parameter associated with the room. More particularly, the environmental parameter can include, without limitation, a temperature of the room, a humidity of the room, the presence of toxins or other harmful substances in a room (e.g., carbon monoxide), or other suitable parameter.

In some embodiments, the ceiling fan can include various data acquisition devices, such as a microphone, an image capture device, or any combination thereof. The microphone can capture audible sounds originating within the room or within a proximity of the room, such as audio generated from a person or persons in a room. The image capture device can be configured to capture one or more images of at least a portion of the room. In some implementations, the at least a portion of the room can include a doorway through which a person enters or exits the room. In this way, the one or more images captured by the camera can depict a person entering or exiting the room.

According to example aspects of the present disclosure, the ceiling fan can include one or more computing devices. As used herein, the computing device(s) refer to components used to perform computations and can include controllers, one or more processors and one or more memory devices, etc. The computing device(s) can be in communication with the data acquisition device(s) and the sensor(s). In this way, the computing device(s) can receive one or more data signals from the data acquisition device(s) and the sensor(s). As will be discussed below, the computing device(s) can be configured to control operation of the ceiling fan based, at least in part, on the data signals.

In some embodiments, the computing device(s) can include a communication interface for communicating information (e.g., data signals collected from the sensor(s) and data acquisition devices) to other devices (e.g., servers, user devices, control systems, thermostat, etc.). For instance, the ceiling fan can stream or otherwise communicate image data captured by the camera and/or audio data captured by the microphone to a user device (e.g., smartphone, tablet, wearable device, etc.) or other device (e.g., control system, security system) for observation of the room or space by the user.

The ceiling fan can communicate directly with other devices (e.g., using peer-to-peer communication) and/or can communicate with other devices over a network. The network can be any suitable type of network, such as a local area network (e.g., intranet), wide area network (e.g., internet), low power wireless network (e.g., Bluetooth Low Energy (BLE), Zigbee, etc.), or some combination thereof and can include any number of wired or wireless links. In general, communication over the network can be implemented via any type of wired or wireless connection, using a wide variety of communication protocols, encodings or formats, and/or protection schemes.

Example communication technologies used in accordance with example aspects of the present disclosure can include, for instance, Bluetooth low energy, Bluetooth mesh networking, near-field communication, Thread, TLS (Transport Layer Security), Wi-Fi (e.g., IEEE, 802.11), Wi-Fi Direct (for peer-to-peer communication), Z-Wave, Zigbee, Halow, cellular communication, LTE, low-power wide area networking, VSAT, Ethernet, MoCA (Multimedia over Coax Alliance), PLC (Power-line communication), DLT (digital line transmission), etc. Other suitable wired and/or wireless communication technologies can be used without deviating from the scope of the present disclosure.

In some implementations, the computing device(s) can be configured to control operation of the ceiling fan based at least in part on information (e.g., data signals collected from the data acquisition devices) indicating the presence of a person within the room. For instance, the computing device(s) can be configured to generate a control action associated with activating (e.g., turning on) the light source of the ceiling fan. In this way, the light source can illuminate the room while the room is occupied by the person. Alternatively or additionally, the computing device(s) can be configured to generate a control action associated with activating the motor to rotate the impeller and draw primary air into the housing. In this way, air within the room can be circulated while the room is occupied by the person.

Other suitable devices are contemplated by the present disclosure. For instance, the ceiling fan can communicate with a control system configured to adjust a position of window blinds in the room. The one or more control signals can command the control system to adjust the position of the window blinds to or towards a fully open position or a fully closed position. In this way, an amount of natural light that enters the room can be controlled.

Referring now to the FIGS., FIG. 1 depicts a bladeless ceiling fan 100 according to example embodiments of the present disclosure. As shown, the ceiling fan 100 can be removably mounted to a ceiling 110. In some applications, the ceiling 110 can separate a first space 112 (e.g., positioned beneath the ceiling 110) from a second space 114 (e.g., positioned above the ceiling 110) along a vertical direction V. More specifically, the fan 100 can be secured to the ceiling 110 via a mounting bracket 116. As shown, the first space 112 is defined between the ceiling 110 and a floor 118 along the vertical direction V.

Referring now to FIGS. 2-5, the fan 100 defines a coordinate system that includes a vertical direction V, a radial direction R, and a circumferential direction C. As shown, the fan 100 can include a housing 120 and an airfoil 130. In some implementations, the housing 120 and the airfoil 130 can be integrally formed as a monolithic component. In alternative embodiments, the housing 120 can be coupled to the airfoil 130 via one or more conduits 150. However, it should be understood that, in some implementations, the housing 120, airfoil 130, and the one or more conduits 150 can be integrally formed as a monolithic component.

In some implementations, the airfoil 130 can be suspended from the housing 120 via a pair of conduits 150 spaced apart from one another along the circumferential direction C. As shown, each conduit of the pair of conduit 150 can extend from the housing 120 to the airfoil 130 along the radial direction R. However, in some implementations, each conduit of the pair of conduits 150 can extend from the housing 120 to the airfoil 130 along both the radial direction R and the vertical direction V. In this manner, at least a portion of the housing 120 can be positioned between the ceiling 110 and the airfoil 130 along the vertical direction V.

In some embodiments, the one or more conduits 150 can include an apron that extends from the housing 120 to the airfoil 130. More specifically, the apron can extend along the circumferential direction C between about 30 degrees and about 360 degrees. In this manner, the apron can extend along at least a portion of the airfoil 130.

It should be understood that the one or more conduits 150 extend between a first end and a second end. In some implementations, a cross-sectional area at the first end of the one or more conduits 150 can be different than a cross-sectional area at the second end of the one or more conduits 150. For instance, in some implementations, the cross-sectional of the first end positioned at or adjacent the housing 120 can be smaller than the cross-sectional area of the second end positioned at or adjacent the airfoil 130. In alternative implementations, the cross-sectional area of the first end positioned at or adjacent the housing 120 can be greater than the cross-sectional area of the second end positioned at or adjacent the airfoil 130.

As shown, the airfoil 130 can define an opening 160 through which air may be directed. In some implementations, a portion of the housing 120 can extend into the opening 160 along the vertical direction V. As will be discussed below in more detail, the fan 100 can direct air through the opening 160 to circulate air within the first space 112 (FIG. 1).

Figure 6:
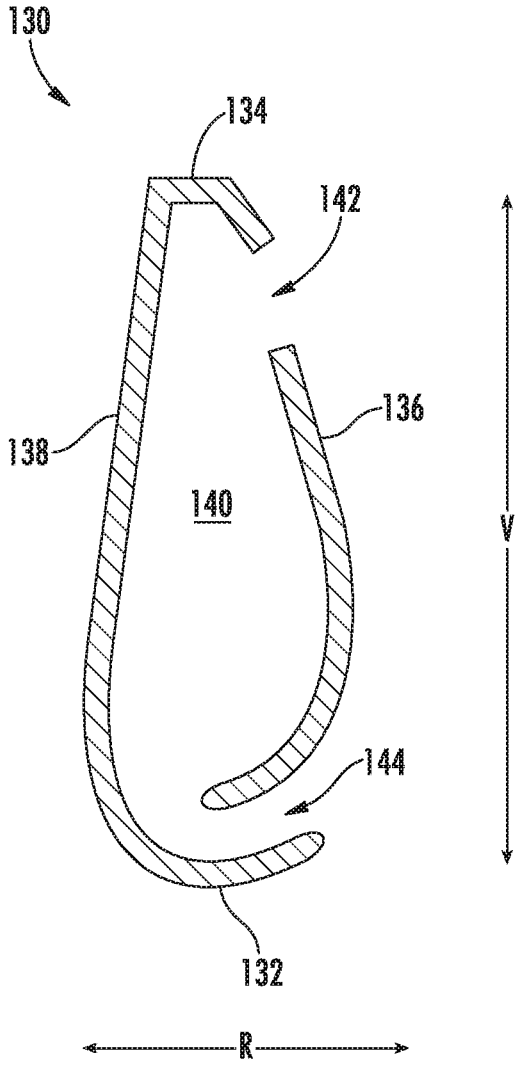
FIG. 6 provides a cross-sectional view of an airfoil of a bladeless ceiling fan according to example embodiments of the present disclosure.

Referring now to FIG. 6, a cross-section of the airfoil 130 is provided according to example embodiments of the present disclosure. As shown, the airfoil 130 can extend between a leading edge 132 and a trailing edge 134 along the vertical direction V. Additionally, the airfoil 130 can extend between a pressure side 136 and a suction side 138 along the radial direction R. In some implementations, the airfoil 130 can define an interior passage 140. As shown, the pressure side 136 of the airfoil 130 can define an inlet 142 and an outlet 144. In this manner, air can flow into and out of the interior passage 140 via the inlet 142 and outlet 144, respectively. For example, air within the one or more conduits 150 can flow into the interior passage 140 via the inlet 142. Furthermore, the air can exit the interior passage 140 via the outlet 144. In some implementations, a cross-sectional area of the outlet 144 can be different than a cross-sectional area of the inlet 142.

Figure 7:
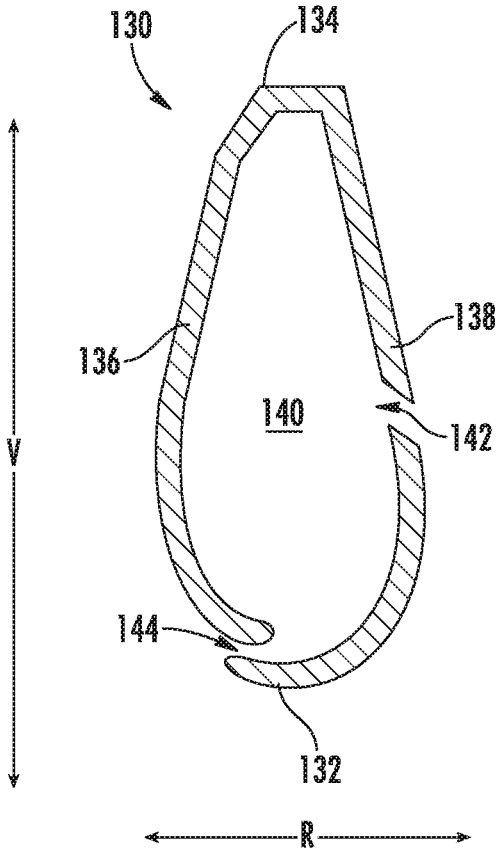
FIG. 7 provides a cross-sectional view of an airfoil of a bladeless ceiling fan according to example embodiments of the present disclosure.

Referring now to FIG. 7, a cross-section of the airfoil 130 is provided according to example embodiments of the present disclosure. The airfoil 130 depicted in FIG. 7 is substantially similar to the airfoil 130 depicted in FIG. 6. For instance, the airfoil 130 of FIG. 7 extends between the pressure side 136 and the suction side 138 along the radial direction R. However, in contrast to the airfoil 130 of FIG. 6, the suction side 138 of the airfoil 130 in FIG. 7 defines the inlet 142.

Figure 8:
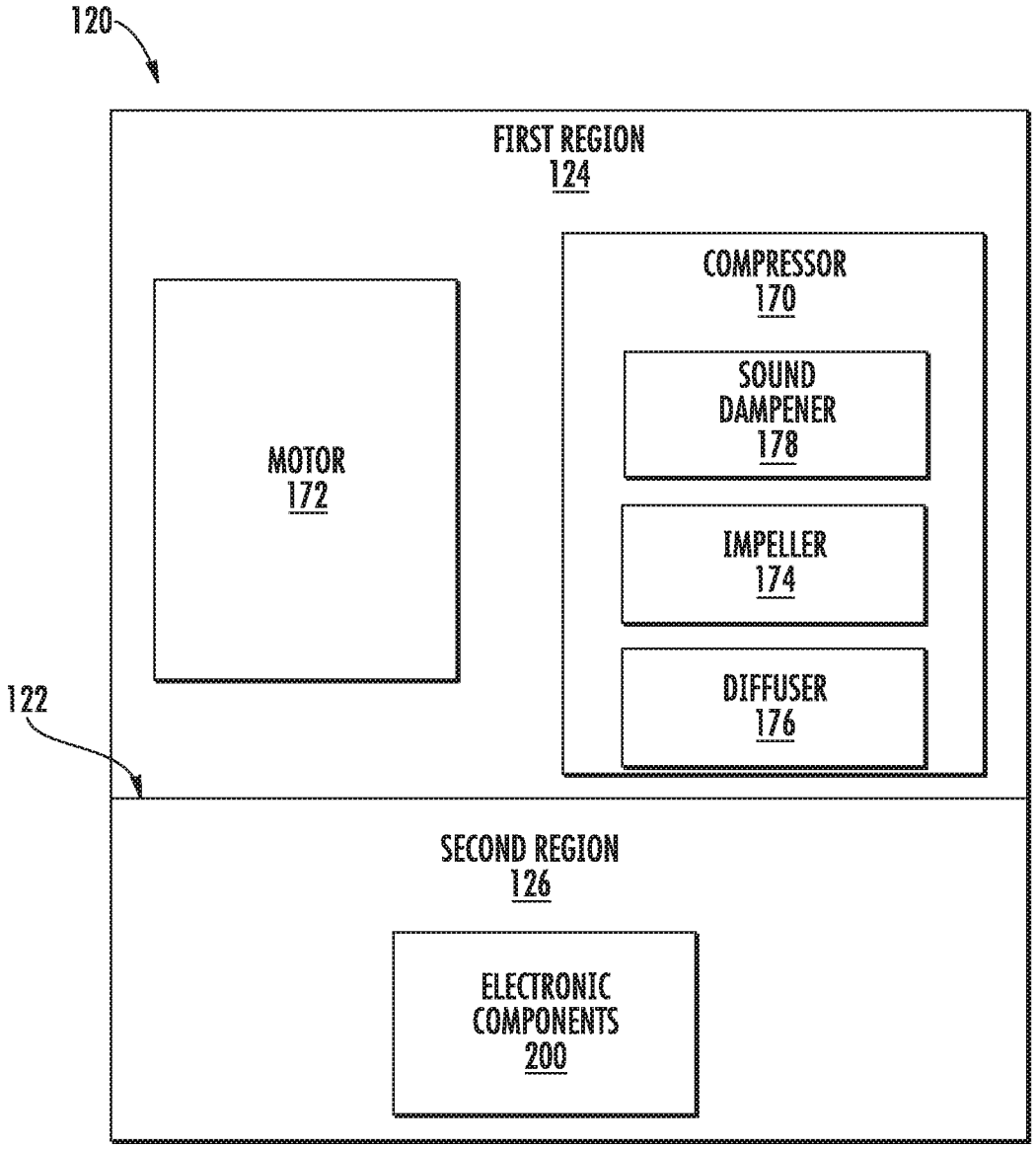
FIG. 8 provides a cross-sectional view of a housing of a bladeless ceiling fan according to example embodiments of the present disclosure.

Referring now to FIG. 8, a cross-sectional view of the housing 120 is provided according to example embodiments of the present disclosure. As shown, the housing 120 can include a bulkhead 122 that divides the interior of the housing 120 into a first region 124 and a second region 126. It should be appreciated that the size of the first region 124 can be different than the size of the second region 126. For instance, the size of the first region 124 can be greater than the size second region 126. Alternatively, the size of the first region 124 can be less than the size of the second region 126. As mentioned above, the housing 120 can, in some embodiments, be integrally formed with the airfoil 130 as a monolithic component. In this manner, the first region 124 can be in direct fluid (e.g., air) communication with the interior passage 140 (FIGS. 6 and 7) defined by the airfoil 130.

Figure 2:
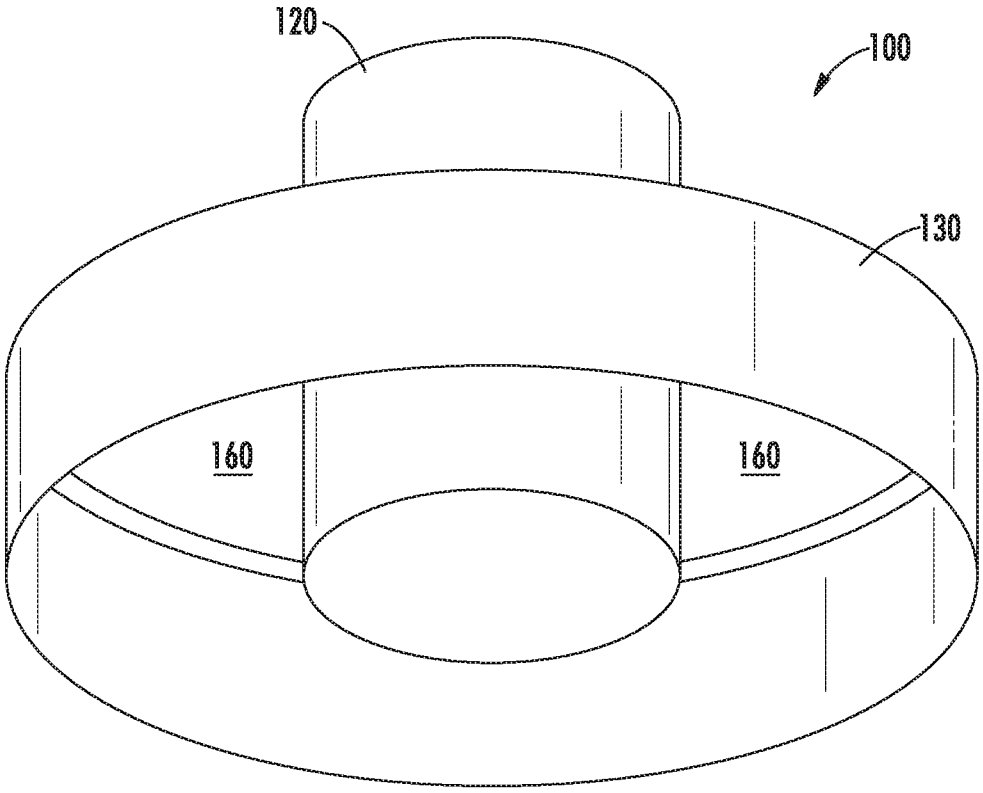
FIG. 2 provides a perspective view of a bladeless ceiling fan according to example embodiments of the present disclosure.
Figure 3:
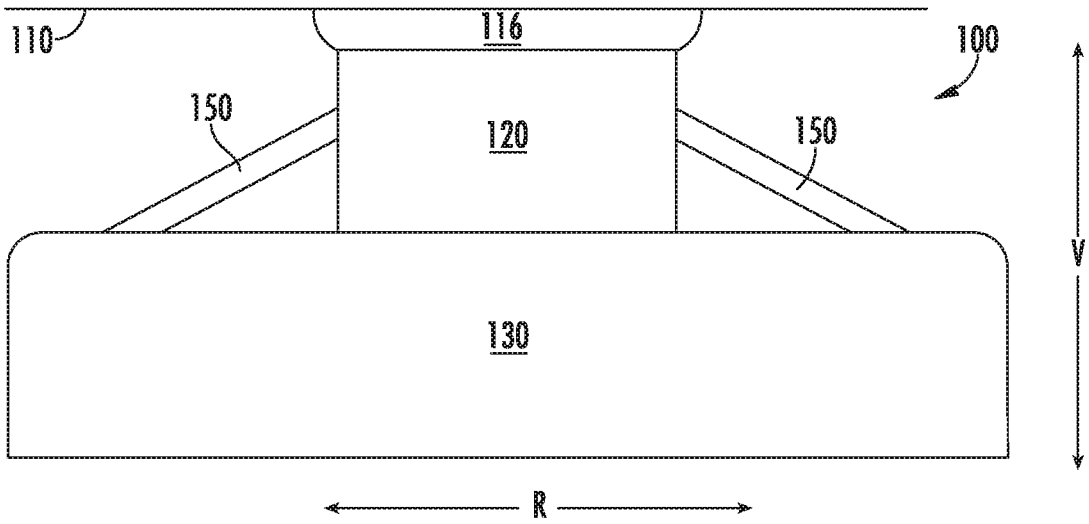
FIG. 3 provides a side view of a bladeless ceiling fan according to example embodiments of the present disclosure.

Referring briefly now to FIGS. 2 and 8 in combination, the airfoil 130 (FIG. 2) can be suspended from the housing 120 via the one or more conduits 150 (FIG. 2) such that the first region 124 of the housing 120 is positioned between the airfoil 130 and the ceiling 110 (FIG. 2) along the vertical direction V. In this manner, the first region 124 of the housing 120 can be spaced apart from the airfoil 130 along the vertical direction V. Alternatively or additionally, the airfoil 130 can be suspended from the housing 120 via the one or more conduits 150 such that at least a portion of the second region 126 of the housing 120 is positioned within the opening 160 (FIG. 2) defined by the airfoil 130.

As shown in FIG. 8, the fan can 100 can include a compressor 170 and an electric motor 172 (e.g., alternating current (AC) motor or direct current (DC) motor). The compressor 170 can include an impeller 174 and a diffuser 176. As shown, the compressor 170 and the motor 172 can be disposed within the first region 124 of the housing 120. In this manner, both the compressor 170 and the motor 172 can be positioned between the airfoil 130 (FIG. 2) and the ceiling 110 (FIG. 2) along the vertical direction V. The motor 172 can receive electrical energy (e.g., AC power or DC power) from a power source (e.g., mains power supply) and can convert the electrical energy into mechanical energy needed to drive rotation of one or more blades (not shown) of the impeller 174. In this manner, the compressor 170 can draw air into the interior of the housing 120 via one or more vents defined by the housing 120. More specifically, the impeller 174 can draw the air through one or more vents defined by first region 124 of the housing 120. In some embodiments, the impeller 174 can include a single row of blades. In alternative embodiments, the impeller 174 can include multiple stages of blades. More specifically, the stages of blades can be spaced apart from one another along the vertical direction V. Alternatively or additionally, the compressor 170 can include a sound damper 178 configured to reduce or eliminate noise associated with operation of the compressor 170. More specifically, the sound damper 178 can be configured to reduce or eliminate noise associated with operation of the impeller 174.

In some implementations, the fan 100 can include one or more electronic components 200. As shown, the one or more electronic components 200 can be disposed within the second region 126 of the housing 120. As will be discussed below in more detail, the one or more electronic components 200 can include one or more computing devices configured to control operation of the fan 100 according to example embodiments of the present disclosure.

Figure 9:
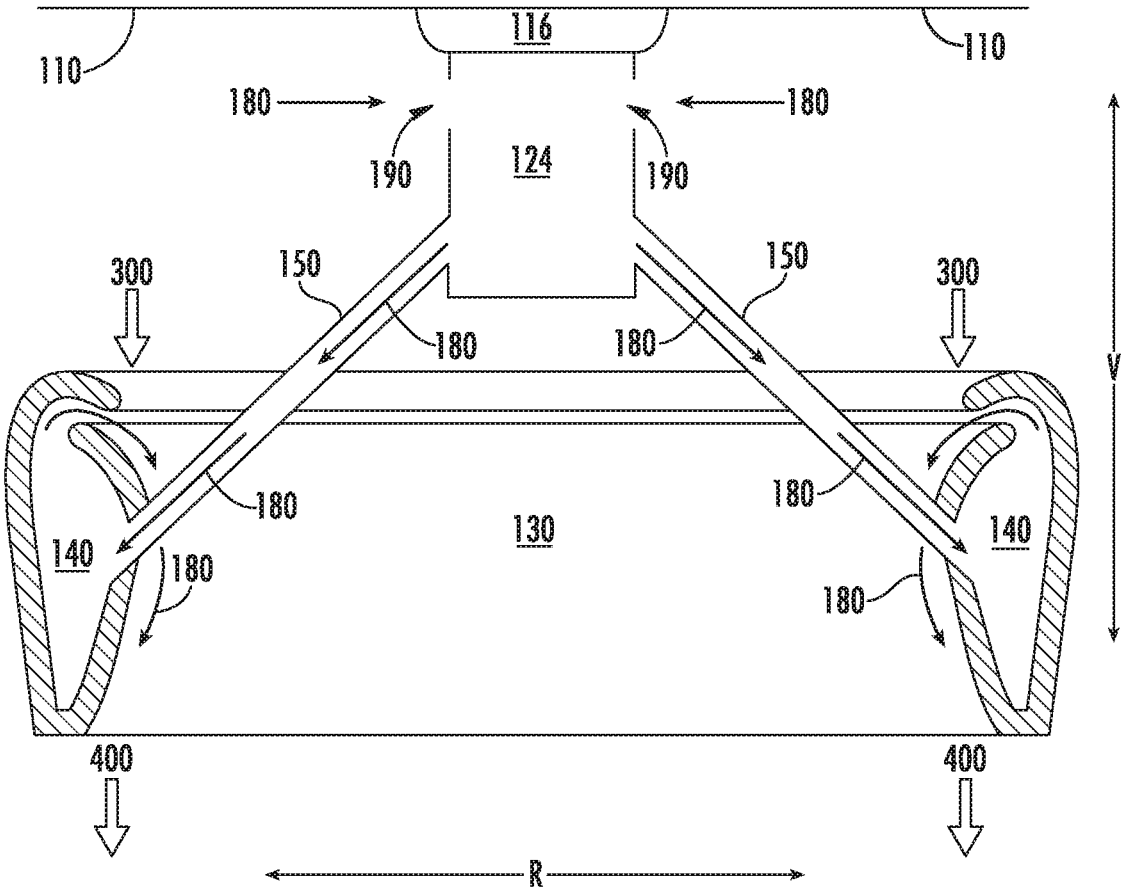
FIG. 9 provides a cross-sectional view of a bladeless ceiling fan according to example embodiments of the present disclosure.

Referring now to FIG. 9, a cross-sectional view of the fan 100 is provided according to example embodiments of the present disclosure. In some implementations, the motor 172 (FIG. 8) can drive rotation of the impeller 174 (FIG. 8) to draw primary air 180 through one or more vents 190 defined by the housing 120. As shown, the vents 190 are positioned along the vertical direction V between the bulkhead 122 (FIG. 8) and a top portion of the first region 124. It should be appreciated, however, that the vents 190 can be positioned at any suitable location on the housing 120 (FIG. 8).

In some implementations, the impeller 174 (FIG. 8) can draw the primary air 180 through the one or more vents 190 and into the first region 124 of the housing 120. Once inside the first region 124 of the housing 120, the primary air 180 can be directed into the one or more conduits 150 via the diffuser 176 (FIG. 8). As shown, the primary air 180 can flow through the one or more conduits 150 and into the interior passage 140 defined by the airfoil 130. Once inside the interior passage 140, the primary air 180 can flow towards the outlet 144 (FIGS. 6 and 7) of the airfoil 130. In this manner, the primary air 180 can exit the interior passage 140 and can flow through the opening 160 (FIG. 4) and along the vertical direction V towards the floor 118 (FIG. 1). More specifically, the primary air flow 180 can flow over an exterior surface of the pressure side 136 (FIGS. 6 and 7) of the airfoil 130.

As the primary air 180 flows over the exterior surface of the pressure side 136, a Coanda effect occurs in which secondary air 300 is drawn through the opening 160. More specifically, a portion of the secondary air 300 can flow over the exterior surface of the pressure side 136. In some implementations, the primary air 180 and the portion of the secondary air 300 flowing over the exterior surface of the pressure side 136 can combine to produce a total air flow 400 directed downward along the vertical direction V towards the floor 118. More specifically, the total air flow 400 produced by the fan 100 can be greater than the total air flow produced by traditional ceiling fans having one or more blades. In this manner, the fan 100 can circulate air within the first space 112 (FIG. 1) in a more efficient manner compared to traditional ceiling fans having one or more blades.

Figure 4:
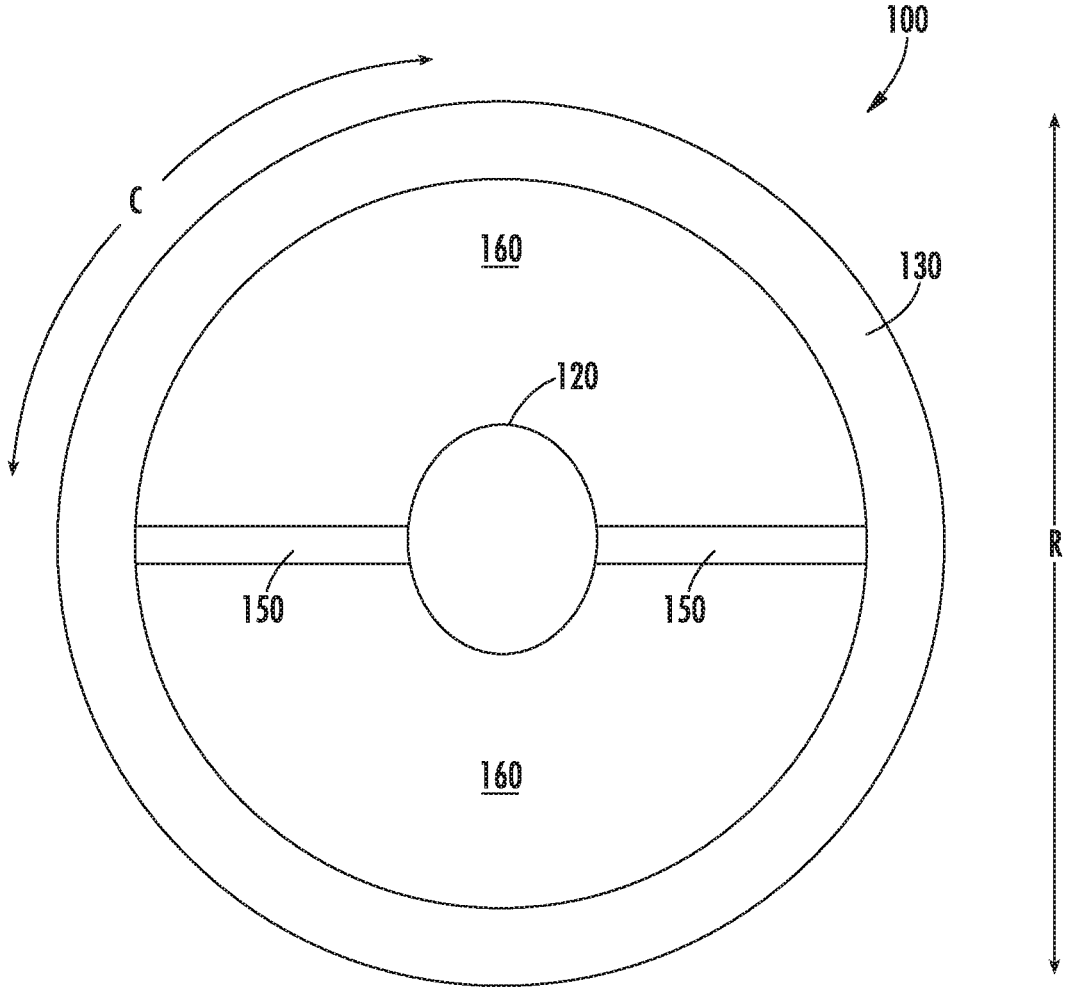
FIG. 4 provides a top view of a bladeless ceiling fan according to example embodiments of the present disclosure.
Figure 5:
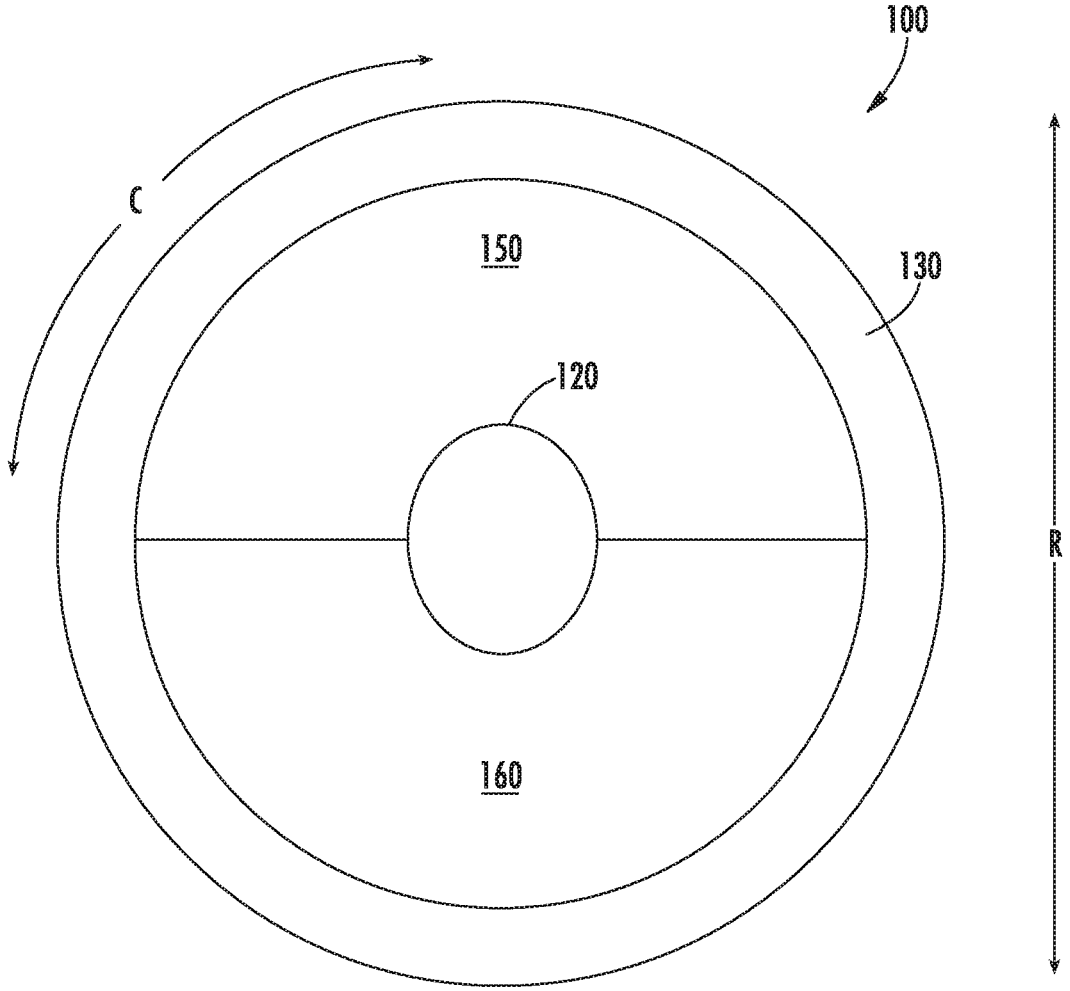
FIG. 5 provides a top view of a bladeless ceiling fan according to example embodiments of the present disclosure.
Figure 10:
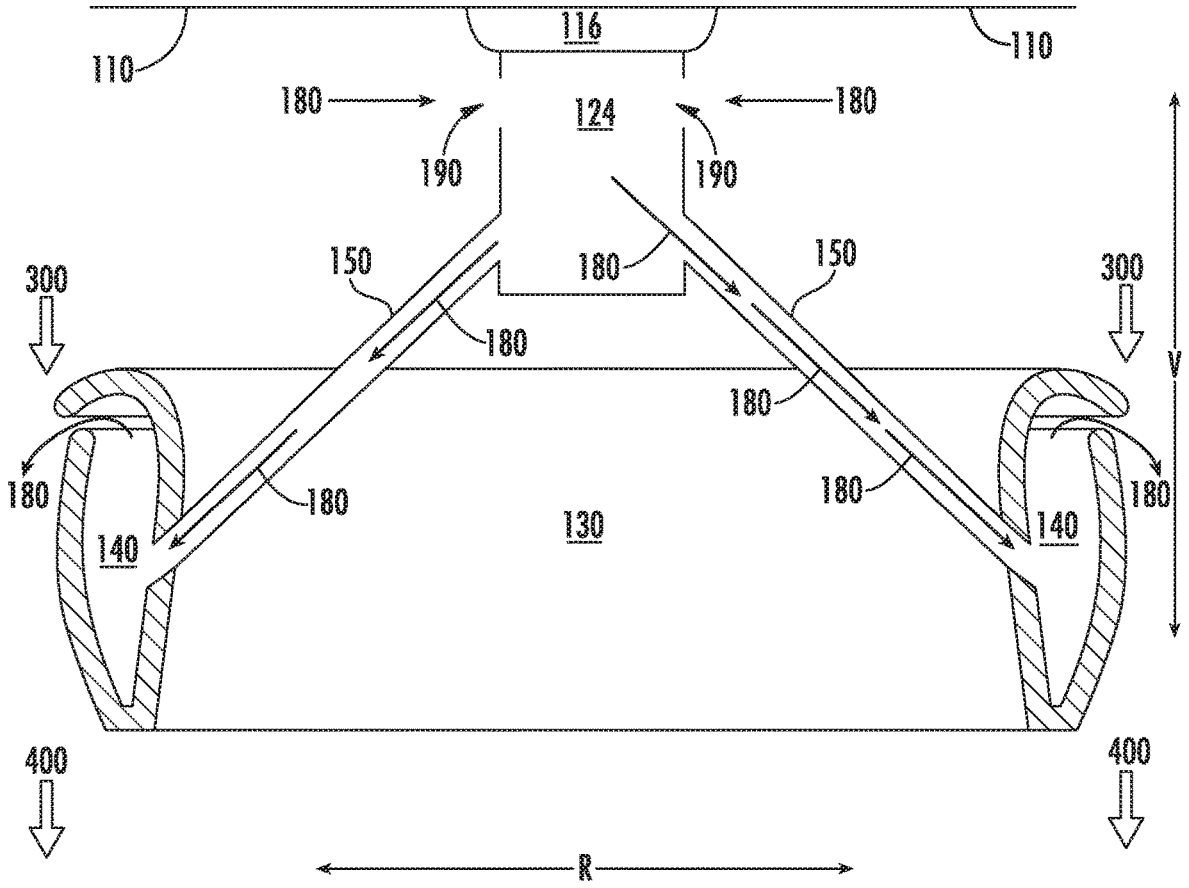
FIG. 10 provides a cross-sectional view of a bladeless ceiling fan according to example embodiments of the present disclosure.

Referring now to FIG. 10, a cross-sectional view of the fan 100 is provided according to example embodiments of the present disclosure. The fan 100 depicted in FIG. 10 is substantially similar to the fan 100 depicted in FIG. 9. For instance, the fan 100 depicted in FIG. 10 includes an airfoil 130. However, the airfoil 130 of the fan 100 in FIG. 10 is oriented differently compared to the airfoil 130 of the fan 100 in FIG. 9. More specifically, the pressure side 136 (FIG. 6) of the airfoil 130 in FIG. 9 defines the inlet 142 (FIG. 6) through which the primary air 180 enters the interior passage 140 (FIG. 6). In contrast, the suction side 138 (FIG. 7) of the airfoil 130 in FIG. 10 defines the inlet 142 (FIG. 7) through which the primary air 180 enters the interior passage 140 (FIG. 7). As the primary air 180 flows over the exterior surface of the pressure side 136 (FIG. 7) of the airfoil 130 depicted in FIG. 10, a Coanda effect occurs in which at least a portion of the secondary air 300 is drawn over the exterior surface of the pressure side 136 (FIG. 7) of the airfoil 130. However, in contrast to the embodiment depicted in FIG. 8, the portion of the secondary air 300 in FIG. 10 does not flow through the opening 160 (FIG. 4).

Figure 11:
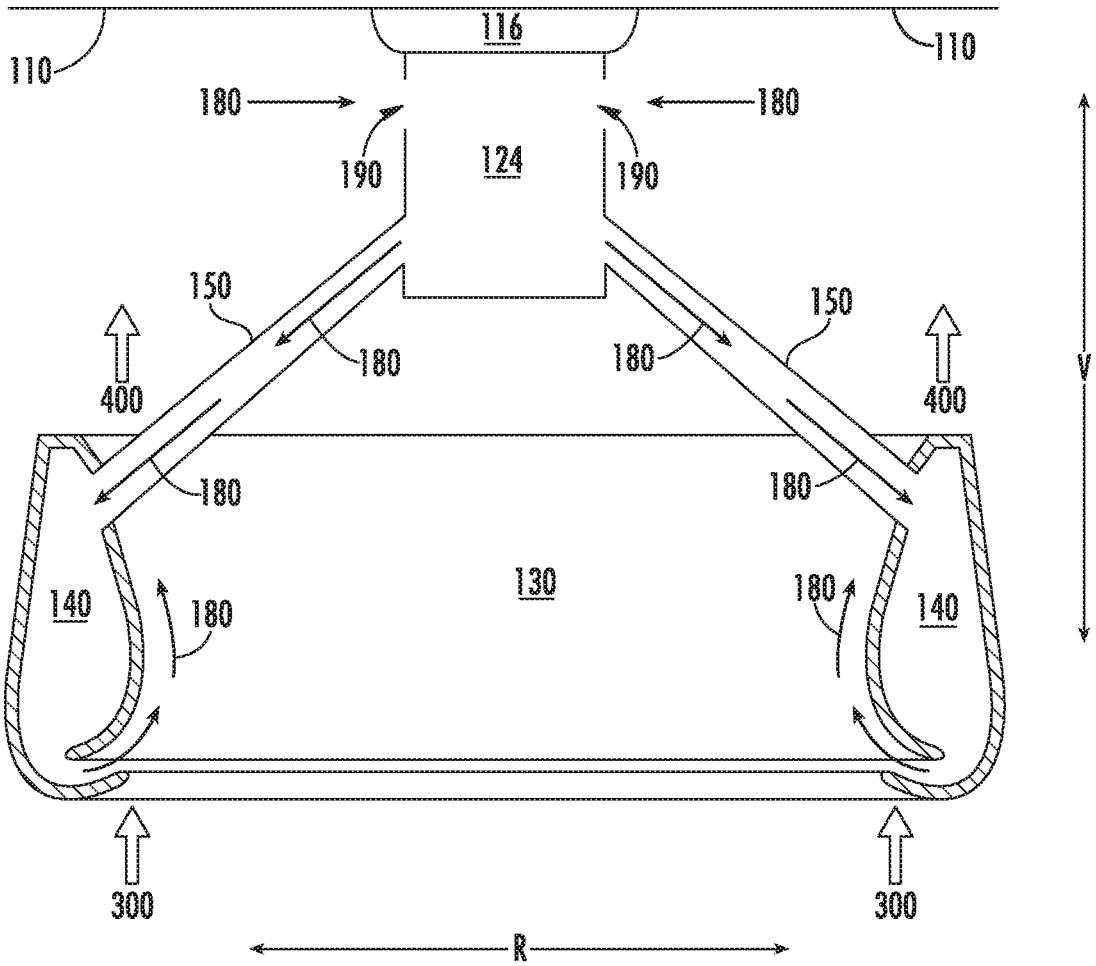
FIG. 11 provides a cross-sectional view of a bladeless ceiling fan according to example embodiments of the present disclosure.

Referring now to FIG. 11, a cross-sectional view of the fan 100 is provided according to example embodiments of the present disclosure. The fan 100 depicted in FIG. 11 is substantially similar to the fan 100 depicted in FIG. 9. However, the fan 100 in FIG. 11 operates differently compared to the fan 100 in FIG. 9. More specifically, the airfoil 130 of the fan 100 in FIG. 9 directs the total air flow 400 towards the floor 118. In contrast, the airfoil 130 of the fan 100 in FIG. 11 directs the total air flow 400 towards the ceiling 110 of the first space 112 (FIG. 1). For at least this reason, it should be appreciated that the fan arrangement 100 in FIG. 11 may be preferred during the winter months (e.g., December to March), whereas the fan arrangement 100 depicted in FIG. 9 may be preferred during the summer months (e.g., June to September).

Figure 12:
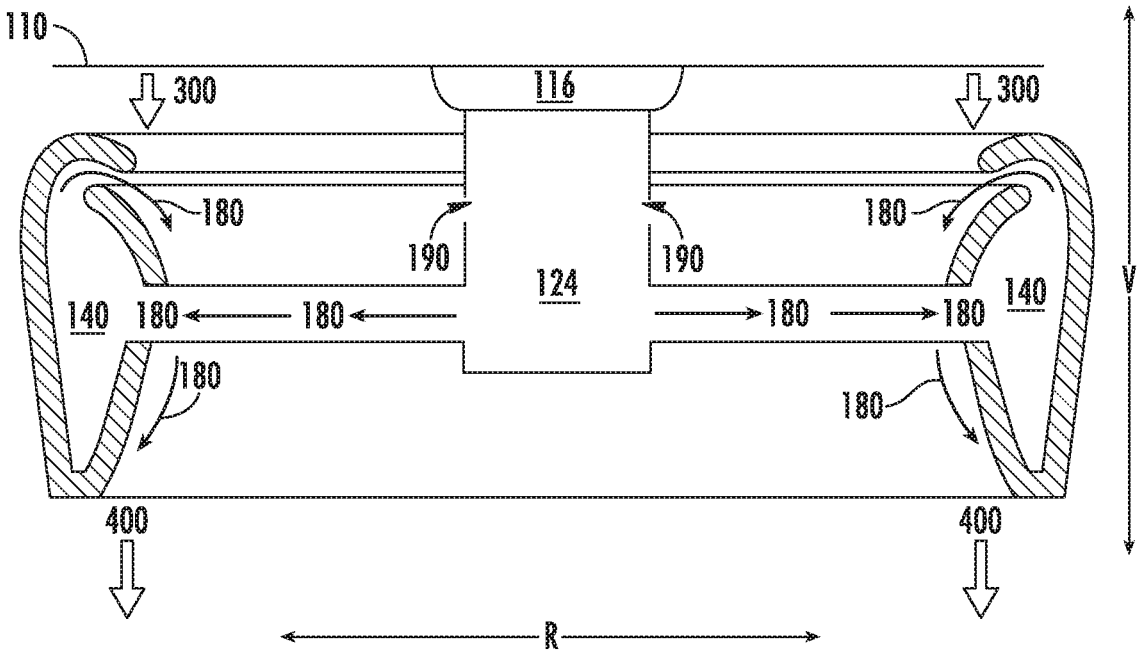
FIG. 12 provides a cross-sectional view of a bladeless ceiling fan according to example embodiments of the present disclosure.

Referring now to FIG. 12, a cross-sectional view of the fan 100 is provided according to example embodiments of the present disclosure. The fan 100 depicted in FIG. 12 is substantially similar to the fan 100 depicted in FIG. 9. For instance, the fan 100 in FIG. 12 includes one or more conduits 150. However, the one or more conduits 150 depicted in FIG. 12 differ from the one or more conduits 150 depicted in FIG. 9. More specifically, the one or more conduits 150 in FIG. 9 extend from the first portion 124 of the housing 120 to the airfoil 130 along both the radial direction R and the vertical direction V. In contrast, the one or more conduits 150 in FIG. 12 extend from the first portion 124 of the housing 120 to the airfoil 130 along only the radial direction R. In this manner, the conduits 150 in FIG. 12 are planar with the airfoil 130.

Figure 13:
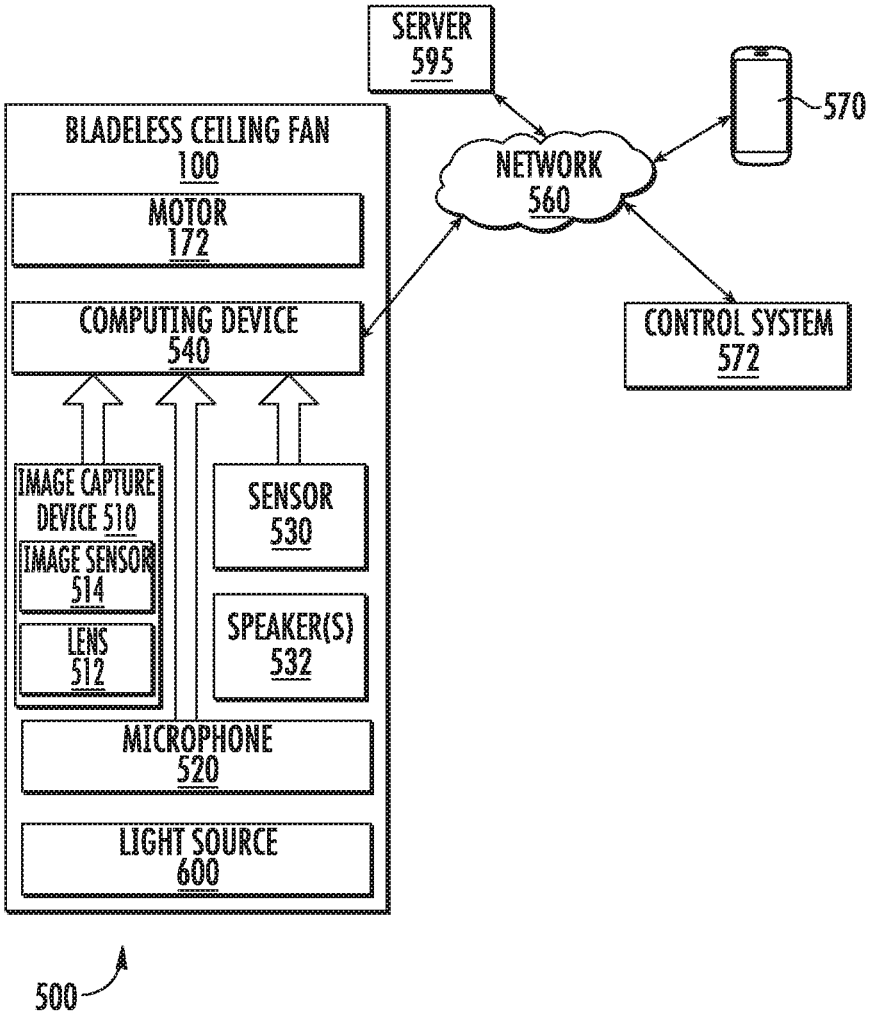
FIG. 13 provides a block diagram of a system for a bladeless ceiling fan according to example embodiments of the present disclosure.

Referring now to FIG. 13, a block diagram of a system 500 for the bladeless ceiling fan 100 is provided according to example embodiments of the present disclosure. As shown, the system 500 can include an image capture device 510 (e.g., camera) coupled to or located within the housing 120 of the fan 100. In some implementations, the image capture device 510 can include a lens 512 and an image sensor 514. The lens 512 can focus light (e.g., visible, infrared) onto the image sensor 514. More specifically, the lens 512 can focus light that is within a field of view of the lens 512. The field of view of the lens 512 can be any suitable value. For instance, the lens 512 can be a panoramic lens whose field of view is equal to three hundred and sixty degrees (360°). Alternatively, the lens 512 can be a fisheye lens. More specifically, the fisheye lens can have a field of view between one hundred and fifty degrees (150°) and one hundred and eighty degrees (180°).

The image sensor 514 can convert the light into an image depicting whatever is within the field of view of the lens 512. In example embodiments, a portion of the first space 112 (FIG. 1) can be within the field of view of the lens 512. More specifically, the portion of the first space 112 can include a doorway 182 (FIG. 1) through which a person enters and exits the first space 112. In this way, the image capture device 510 can capture one or more images (e.g., video) of a person entering or exiting the first space 112 (FIG. 1).

The system 500 can include a microphone 520. More specifically, the microphone 520 can be coupled to or located within the housing 120 or other portion of the fan 100. In this way, the microphone 520 can detect audible sounds occurring within the first space 112 or within a predetermined proximity of the first space 112. The microphone 520 can convert the audible sounds to electrical signals indicative of the audio in the space.

The system 500 can also include one or more sensor(s) 530 coupled to the fan 100 and operable to sense at least one environmental parameter of the first space 112. More particularly, the sensor(s) 530 can be coupled to the housing 120 of the fan 100. In some implementations, the sensor(s) 530 can detect humidity (e.g., specific, relative, etc.) of the air within the first space 112. Alternatively or additionally, the sensor(s) 530 can detect a temperature of the air within the first space 112. It should be appreciated that the present disclosure is not limited to the environmental parameters (that is, humidity and temperature) discussed above. For example, the environmental parameter can include, without limitation, a carbon monoxide (CO) sensor and a radon gas sensor.

In some embodiments, the system 500 can include one or more speakers 532 configured to emit white noise. More specifically, the speaker(s) 532 can be configured to emit white noise while the fan 100 is operating. For instance, the speaker(s) 532 can emit the white noise while the motor 172 of the fan 100 is driving rotation of the impeller 174 to draw primary air into the housing 120. In this manner, the speaker(s) 532 emitting the white noise can further reduce noise associated with operation of the fan 100.

As shown, the system 500 can include one or more computing devices 540. In some implementations, the computing device(s) 540 can be coupled to or located within the housing 120 or other portion of the fan 100.

Figure 14:
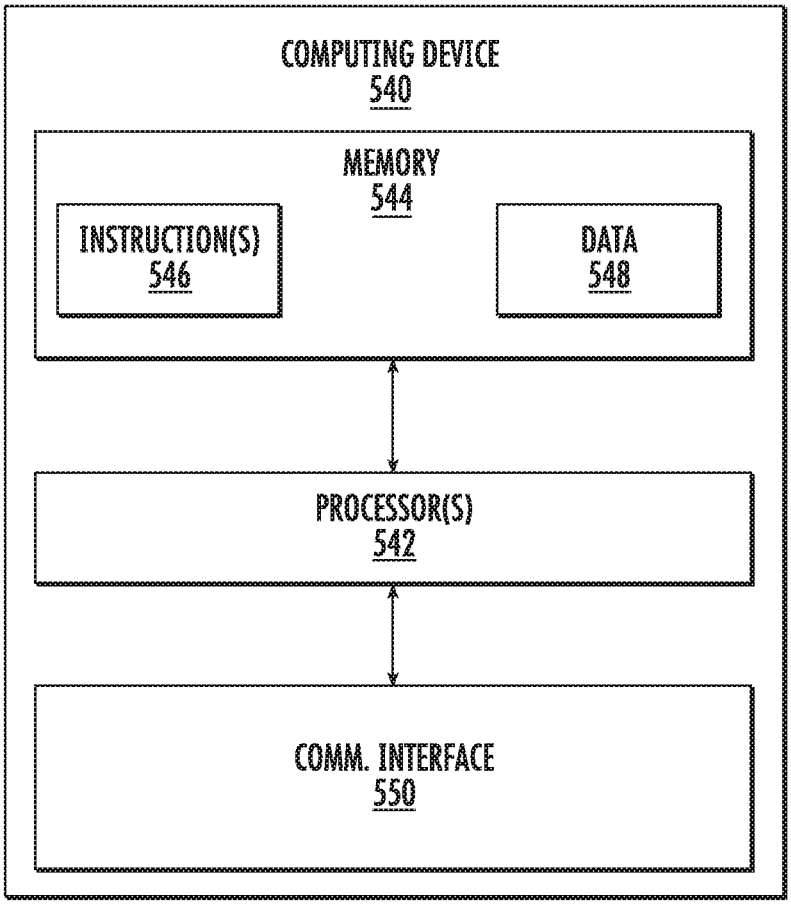
FIG. 14 provides a block diagram of components of a computing device according to example embodiments of the present disclosure.

FIG. 14 illustrates one embodiment of suitable components of the computing device(s) 540. As shown, the computing device(s) 540 can include at least one processor 542 configured to perform a variety of computer-implemented functions (e.g., performing the methods, steps, calculations and the like disclosed herein). As used herein, the term "processor" refers not only to integrated circuits referred to in the art as being included in a computer, but also refers to a controller, microcontroller, a microcomputer, a programmable logic controller (PLC), an application specific integrated circuit (ASIC), a Field Programmable Gate Array (FPGA), and other programmable circuits.

In addition, the computing device(s) 540 can include a memory device 544. Examples of the memory device 544 can include computer-readable media including, but not limited to, non-transitory computer-readable media, such as RAM, ROM, hard drives, flash drives, or other suitable memory devices. The memory device 544 can store information accessible by the processor(s) 542, including computer-readable instructions 546 that can be executed by the processor(s) 542. The computer-readable instructions 546 can be any set of instructions that, when executed by the processor(s), cause the processor(s) 542 to perform operations. The computer-readable instructions 546 can be software written in any suitable programming language or can be implemented in hardware. In some example embodiments, the computer-readable instructions 546 can be executed by the computing device(s) 540 to perform operations, such as generating one or more control actions to control operation of the ceiling fan 100. In some embodiments, the computer-readable instructions 546 can be executed by the computing device(s) 540 to communicate information to one or more other remote devices.

The memory device 544 can further store data 548 that can be accessed by the computing device(s) 540. In example embodiments, the data 548 can include image data captured by the image capture device 510, data indicative of an environmental parameter detected by the sensor(s) 530, audible sounds detected by the microphone 520, or any combination thereof.

Additionally, as shown in FIG. 14, the computing device(s) 540 can include a communications interface 550. In example embodiments, the communications interface 550 can include associated electronic circuitry that can be used to communicatively couple the computing device(s) 540 with other devices, such as a user device 570, a control system 572, a server 595, or any other computing device. In some embodiments, the communication interface 550 can allow the computing device(s) 540 to communicate directly with other devices. In some embodiments, the communication interface 550 can provide for communication with other devices over a network 560.

The network 560 can be any suitable type of network. The network can be any suitable type of network, such as a local area network (e.g., intranet), wide area network (e.g., internet), low power wireless network (e.g., Bluetooth Low Energy (BLE), Zigbee, etc.), or some combination thereof and can include any number of wired or wireless links. In general, communication over the network can be implemented via any type of wired or wireless connection, using a wide variety of communication protocols, encodings or formats, and/or protection schemes.

Example communication technologies used in accordance with example aspects of the present disclosure can include, for instance, Bluetooth low energy, Bluetooth mesh networking, near-field communication, Thread, TLS (Transport Layer Security), Wi-Fi (e.g., IEEE, 802.11), Wi-Fi Direct (for peer-to-peer communication), Z-Wave, Zigbee, Halow, cellular communication, LTE, low-power wide area networking, VSAT, Ethernet, MoCA (Multimedia over Coax Alliance), PLC (Power-line communication), DLT (digital line transmission), etc. Other suitable wired and/or wireless communication technologies can be used without deviating from the scope of the present disclosure.

In some implementations, the computing device(s) 540 can control operation of the fan 100 via communications with one or more devices on the network 560. For instance, the computing device(s) 540 can communicate with a control system 572 to activate (e.g., turn on) or deactivate (e.g., turn off) a light source 600 (not shown) of the fan 100. More specifically, the light source 600 can include one or more light emitting diodes (LEDs). Alternatively or additionally, the computing device(s) 540 can communicate with the control system 572 to activate or deactivate the motor 172. In this way, operation of the fan 100 can be controlled. In some implementations, the computing device(s) 540 can control operation of the image capture device 510 and the fan 100 independently of each other. For example, operation of the image capture device 510 and operation of the light source of the fan 100 can be controlled independently of each other. Alternatively or additionally, operation of the image capture device 510 and operation of the motor 172 can be controlled independently of each other.

In some implementations, the light source 600 can be mounted to a bottom portion of the housing 120 (FIG. 2). Alternatively or additionally, the light source 600 can be mounted to the airfoil 130. In some implementations, the light source 600 can include a plurality of LEDs mounted to the pressure side 136 (FIGS. 6 and 7) of the airfoil 130 (FIGS. 6 and 7) and spaced apart from one another along the circumferential direction C. Alternatively or additionally, the light source 600 can include a plurality of LEDs mounted to the suction side 138 (FIGS. 6 and 7) of the airfoil 130 (FIGS. 6 and 7) and spaced apart from another along the circumferential direction C.

In some implementations, the light source 600 can be controlled independently from operation of the motor 172 (FIG. 8). For instance, the light source 600 can include one or more LEDs operable to provide up lighting or down lighting. More specifically, the computing device(s) 540 can adjust the LEDs to provide up lighting or down lighting based, at least in part, on one more commands received from a user. In some implementations, the command(s) can be received from the user device 570 via the network 560.

Alternatively or additionally, the command(s) can be received via the control system 572.

In some implementations, the computing device(s) 540 can communicate with the user device 570 over the network 560. The user device 570 can be any suitable type of device, such as, for example, a personal computing device (e.g., laptop or desktop), a mobile computing device (e.g., smartphone or tablet), a wearable computing device, an embedded computing device, a remote, or any other suitable type of user computing device. The user device 270 can include one or more computing device(s) with the same or similar components as described above with regard to computing device(s) 540 of the system 500. For instance, the user device 570 can include one or more processors and one or more memory devices that store instructions that are executable by the processor(s) to cause the processor(s) to perform operations, such as e.g., communicating one or more control signals over the network 560 to the computing device(s) 540 of the system 500. In this way, a user can control operation of the fan 100 via the user device 570. In addition, the user can use the user device 570 to control operation of the image capture device 510 and the fan 100 independently of each other.

In some embodiments, the computing device(s) 540 can communicate data to the user device 570 via the communication interface 550. For instance, the computing device(s) 540 can communicate image data captured by the camera and/or audio data captured by the microphone to the user device 570. The information can be displayed (e.g., via a display device) or otherwise presented (e.g., via audio speakers) to the user through a suitable interface. In this way, a user can observe activity in a room or area in which the ceiling fan 100 is mounted.

In some embodiments, the computing device(s) 540 can communicate with a remote computing device, such as a server 595 (e.g., a web server). For instance, the computing device(s) 540 can communicate data collected by the data acquisition devices (e.g., image capture device 510, microphone 520) and/or sensors 530 to the server 595. The server 595 can store a historical record of the data. The data can be accessed, for instance, by a user via a suitable interface (e.g., web browser) implemented on the user device 570.

In some implementations, the server 595 can be configured to process the data collected by the data acquisition devices (e.g., image capture device 510, microphone 520) and/or sensors 530. In addition, the server 595 can be configured to generate one or more control signals based on the processed data. The one or more control signals can be communicated to one or more devices over the network 560. In addition, the one or more control signals can command recipient devices to control operation of the fan 100, the image capture device 510, or both.

In some implementations, software for controlling operation of the fan 100, the system 500, or both can be transmitted over the network 560 to the computing device(s) 540. More specifically, the software can be stored in the memory device 544 and, when executed, can cause the computing device(s) 540 to control operation of the motor 172, the light source 600, the image capture device 510, or any combination thereof. In some implementations, updates to the software can be communicated over the network 560 to the computing device(s) 540. In this way, the software can be updated from a remote device (e.g., the server 595).

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A bladeless ceiling fan defining a vertical direction, a radial direction, and a circumferential direction, the bladeless ceiling fan comprising:

a housing configured to accommodate an electric motor, the housing including at least one sidewall extending along the vertical direction, the at least one sidewall of the housing defining one or more vents through which air enters an interior of the housing, the one or more vents open in the radial direction and spanning along the vertical direction;

an airfoil defining an interior passage in fluid communication with the interior of the housing, the airfoil spaced from the housing along the radial direction; and a mounting bracket coupled to the housing, the mounting bracket configured to couple the bladeless ceiling fan adjacent to a ceiling.

2. The bladeless ceiling fan of claim 1, wherein the airfoil is spaced apart from the housing along the vertical direction.

3. The bladeless ceiling fan of claim 1, further comprising:

one or more conduits extending from the housing to the airfoil such that air within the interior of the housing flows through the one or more conduits and into the interior passage.

4. The bladeless ceiling fan of claim 3, wherein:

the one or more conduits comprises a plurality of conduits spaced apart from one another along the circumferential direction, and each conduit of the plurality of conduits extends from the housing to the airfoil along both the radial direction and the vertical direction.

5. The bladeless ceiling fan of claim 3, wherein:

the one or more conduits extend between a first end and a second end, and a cross-sectional area of the first end is different than a cross-sectional area of the second end.

6. The bladeless ceiling fan of claim 3, wherein:

the airfoil extends between a leading edge and a trailing edge along the vertical direction;

the airfoil extends between a pressure side and a suction side along the radial direction; and the pressure side defines an inlet and an outlet.

7. The bladeless ceiling fan of claim 6, wherein a cross-sectional area of the inlet is different than a cross-sectional area of the outlet.

8. The bladeless ceiling fan of claim 6, wherein the housing comprises a bulkhead configured to divide the interior of the housing into a first region and a second region.

9. The bladeless ceiling fan of claim 3, wherein the housing, the airfoil, and the one or more conduits are integrally formed as a monolithic component.

10. The bladeless ceiling fan of claim 1, further comprising:

an image capture device.

11. The bladeless ceiling fan of claim 1, further comprising:

one or more sensors operable to sense an environmental parameter associated with a room or area in which the fan is mounted.

12. The bladeless ceiling fan of claim 1, further comprising:

a light source.

13. The bladeless ceiling fan of claim 12, wherein the light source is mounted to a pressure side of the airfoil or a suction side of the airfoil.

14. The bladeless ceiling fan of claim 1, wherein the housing and the airfoil are integrally formed as a monolithic component.

15. A bladeless ceiling fan defining a vertical direction, a radial direction, and a circumferential direction, the bladeless ceiling fan comprising:

a housing configured to accommodate an electric motor, the housing defining one or more vents through which air enters an interior of the housing, the one or more vents open in the radial direction;

an airfoil defining an interior passage in fluid communication with the interior of the housing;

a mounting bracket coupled to the housing, the mounting bracket configured to couple the bladeless ceiling fan adjacent to a ceiling;

one or more conduits extending from the housing to the airfoil such that air within the interior of the housing flows through the one or more conduits and into the interior passage; and wherein the airfoil extends between a leading edge and a trailing edge along the vertical direction;

the airfoil extends between a pressure side and a suction side along the radial direction;

the pressure side defines an inlet and an outlet;

the housing comprises a bulkhead configured to divide the interior of the housing into a first region and a second region;

the first region is configured to accommodate the electric motor; and the second region is configured to accommodate one or more computing devices.

16. The bladeless ceiling fan of claim 15, wherein the one or more conduits extend from the first region to the inlet.

17. A system for a bladeless ceiling fan mounted in a room or area, the system comprising:

the bladeless ceiling fan including a housing having a mount end and a distal end, each of the mount end and the distal end being closed;

a mounting bracket coupled to the mount end of the housing, the mounting bracket configured to couple the bladeless ceiling fan to a ceiling;

at least one sidewall extending between the mount end and the distal end along a vertical direction;

one or more vents defined in the at least one sidewall, the one or more vents open in a radial direction that is perpendicular to the vertical direction; and an airfoil spaced from the housing along the radial direction;

an image capture device couplable to the bladeless ceiling fan, the image capture device operable to capture an image depicting at least a portion of the room or area when the image capture device is coupled to the bladeless ceiling fan; and one or more computing devices comprising one or more processors and one or more memory devices, the one or more memory devices storing instructions that, when executed by the one or more processors, cause the one or more processors to perform operations, the operations comprising:

commanding the system to adjust a position of one or more window blinds in the room or area.

18. The system of claim 17, further comprising:

one or more speakers operable to emit white noise while the bladeless ceiling fan is operating, the white noise configured to reduce noise produced by operation of the bladeless ceiling fan.

19. The system of claim 17, further comprising:

a microphone coupleable to the bladeless ceiling fan, the microphone operable to detect one or more audible sounds within the room or area when the microphone is coupled to the bladeless ceiling fan.

20. The system of claim 19, the operations further comprising:

communicating the one or more images to a user device; and communicating the one or more audible sounds to the user device, wherein communicating the one or more images occurs contemporaneously with communicating the one or more audible sounds.

* * * * *